US007134849B1

(12) United States Patent
Steck et al.

(10) Patent No.: US 7,134,849 B1
(45) Date of Patent: Nov. 14, 2006

(54) MOLDED DISPOSABLE PNEUMATIC PUMP

(75) Inventors: Ricky B. Steck, West Jordan, UT (US); Michael Dunn, Sandy, UT (US)

(73) Assignee: Trebor International, Inc., West Jordan, UT (US)

( * ) Notice: Subject to any disclaimer, the term of this patent is extended or adjusted under 35 U.S.C. 154(b) by 402 days.

(21) Appl. No.: 10/421,131

(22) Filed: Apr. 22, 2003

(51) Int. Cl.
*F04B 9/12* (2006.01)

(52) U.S. Cl. ..... 417/384; 417/390; 417/397; 417/413.1

(58) Field of Classification Search ..... 417/397, 417/390, 384, 413.1
See application file for complete search history.

(56) References Cited

U.S. PATENT DOCUMENTS

| | | | | | |
|---|---|---|---|---|---|
| 3,782,863 | A | * | 1/1974 | Rupp | 417/393 |
| 4,123,204 | A | * | 10/1978 | Scholle | 417/393 |
| 4,722,752 | A | | 2/1988 | Steck | 134/25.4 |
| 4,778,356 | A | * | 10/1988 | Hicks | 417/397 |
| 4,781,535 | A | * | 11/1988 | Frawley et al. | 417/53 |
| 4,787,825 | A | | 11/1988 | Mantell | 417/395 |
| 4,836,418 | A | * | 6/1989 | Dinslage | 222/82 |
| 4,842,498 | A | * | 6/1989 | Bramstedt et al. | 417/571 |
| 4,854,832 | A | | 8/1989 | Gardner et al. | 417/395 |
| 4,902,350 | A | | 2/1990 | Steck | 134/1 |
| 4,904,167 | A | | 2/1990 | Eickmann | 417/395 |
| 4,981,418 | A | | 1/1991 | Kingsford et al. | 417/63 |
| 5,062,770 | A | | 11/1991 | Story et al. | 417/375 |
| 5,108,270 | A | * | 4/1992 | Kozumplik, Jr. | 417/393 |
| 5,261,798 | A | | 11/1993 | Budde | 417/393 |
| 5,263,827 | A | | 11/1993 | Esposito et al. | 417/395 |
| 5,326,234 | A | | 7/1994 | Versaw et al. | 417/393 |
| 5,362,212 | A | * | 11/1994 | Bowen et al. | 417/395 |
| 5,409,355 | A | | 4/1995 | Brooke | 417/395 |
| 5,466,133 | A | | 11/1995 | Tuck, Jr. | 418/2 |
| 5,520,523 | A | | 5/1996 | Yorita et al. | 417/387 |
| 5,527,160 | A | | 6/1996 | Kozumplik, Jr. et al. | 417/46 |
| 5,540,568 | A | | 7/1996 | Rosen et al. | 417/395 |
| 5,564,911 | A | | 10/1996 | Santa | 417/395 |
| 5,567,118 | A | | 10/1996 | Grgurich et al. | 417/393 |
| 5,649,813 | A | | 7/1997 | Able et al. | 417/393 |
| 5,816,778 | A | | 10/1998 | Elsey, Jr. et al. | 417/395 |
| 5,860,794 | A | | 1/1999 | Hand et al. | 417/395 |
| 6,106,246 | A | * | 8/2000 | Steck et al. | 417/395 |
| 6,142,749 | A | | 11/2000 | Jack et al. | 417/395 |
| 6,152,704 | A | | 11/2000 | Aboul-Hosn et al. | 417/360 |
| 6,168,394 | B1 | | 1/2001 | Forman et al. | 417/393 |

* cited by examiner

*Primary Examiner*—Anthony D. Stashick
*Assistant Examiner*—Ryan P. Gillan
(74) *Attorney, Agent, or Firm*—Workman Nydegger

(57) ABSTRACT

A mechanical pump having a unitary construction such that the fluid being pumped is prevented from leaking without requiring the use of discrete seal elements. The absence of discrete seal elements and integral coupling of various components of the pump substantially reduces the likelihood of failure of potential leak points. This allows the pump to operate continuously for a longer period and with greater reliability than previously utilized pumps. The pump can be utilized in a greater number of applications without requiring special design consideration for the fluid being pumped. The absence of discrete seal elements also reduces the cost and complexity of manufacturing the pump.

31 Claims, 6 Drawing Sheets

MOLDED DISPOSABLE PNEUMATIC PUMP

BACKGROUND OF THE INVENTION

1. The Field of the Invention

The present invention relates to pumps for displacing fluid. More particularly, the present invention relates to mechanical pumps having a unitary construction for utilizing pumping force to displace a fluid.

2. The Relevant Technology

Mechanical pumps have been utilized for centuries to displace fluids. Modern mechanical pumps are utilized in manufacturing, residential applications, and in hydraulics. Modern pumps are often highly specialized for the application for which they are utilized. The components of the pumps are designed for optimal functionality and versatility.

Many components of mechanical pumps require seal elements to prevent leakage of the fluid being pumped while allowing movement of the movable elements. The use of seal elements increases the number of parts needed to manufacture the pump. Another drawback of seal elements is that they tend to deteriorate and fail more quickly than other pump components. This is due to the materials from which they are formed and the stresses to which they are subjected. Many pump manufacturers construct their pumps to allow replacement of the seal elements on a periodic basis. However, replacement of seal elements can be time consuming and expensive. This can be particularly true where servicing of the pump stops the manufacturing processes of a business. Additionally, the cost of replacement seal elements can be substantial.

Pumps utilized for some applications are subject to conditions and requirements that render the use of seal elements particularly problematic. For example, the use of seal elements can be problematic in pumps utilized in applications requiring ultra high purity of the fluid being pumped. The seal elements utilized in these pump are formed from rubbers, plastics, and/or other materials, which can be suitable for certain ultra high purity applications while being unsuitable for other ultra high purity applications. For example, a seal constructed of rubber can be suitable for the pumping of certain corrosive agents while being unsuitable for use in high temperature applications. In contrast, a plastic seal can be appropriate for high temperature settings but not for pumping certain corrosive agents. This requires that the pump be manufactured with seal elements tailored to the requirements of the fluid to be pumped and the operating conditions of the pump.

Another challenge presented by pumps utilized in ultra high purity applications is that some or all of the seal elements must be isolated from the fluid being pumped. However, failure of a seal or perforation of a diaphragm results in contact between the fluid and the seal elements. The materials used in manufacture of the seals can contaminate the fluid being pumped when contacted by the fluid. Because contamination of the fluid being pumped can result in millions of dollars of ruined product and/or machinery, the possibility of contamination due to perforation of the diaphragm or failure of a seal requires additional leak detection mechanisms for use with the pump.

BRIEF SUMMARY OF THE INVENTION

The present invention relates to a mechanical pump having a unitary construction for utilizing pumping force to displace a fluid. The pump has a unitary construction such that the fluid being pumped is prevented from leaking without the use of discrete seal elements. The unitary construction of the pump can be achieved by integral coupling of various components of the pump. As used herein, the term "unitary" refers to the construction an integration of the components that provide a seal to prevent leakage of the fluid that is pumped. The "unitary" construction and configuration of the pump is in contrast to the use in conventional pumps of discrete seal elements that can be replaced and that mechanically interface with other components of the pump.

The absence of discrete seal elements substantially reduces the number of components that are utilized in the pump. The integral coupling of various components of the pump substantially reduces the likelihood of failure of potential leak points and permits the pump to operate continuously for a longer period and with greater reliability than has been possible using conventional pumps. The absence of discrete seal elements also allows the pump to be utilized in a greater number of applications without requiring special design considerations for the fluid being pumped. Additionally the absence of discrete seal elements and the reduced number of components reduce the costs and complexity of manufacturing the pump.

According to one aspect of the present invention, the pump is a double diaphragm pump constructed such that many or all of the components of the pump are molded or welded to achieve a unitary construction of the pump.

According to another aspect of the present invention, the pump can be constructed of ultra high purity material to avoid contamination of the fluid being pumped as required by some specialized applications. For instance, the pumps constructed according to the invention can be used in semiconductor fabrication applications in which contamination of the material that is pumped is important and in which reliability and continuous use of the pumps are critical.

Because of the unitary construction of the pumps, the eventual failure of the pumps typically results in replacement rather than repair. However, the cost of replacing the pumps of the invention can typically be no more expensive than the cost of repairing conventional pumps in the event of failure of a sealing element.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to a mechanical pump having a unitary construction for utilizing pumping force to displace a fluid. The pump has a unitary construction such that the fluid being pumped is prevented from leaking without the use of discrete seal elements. The unitary construction of the pump can be achieved by integral coupling of various components of the pump.

The absence of discrete seal elements substantially reduces the number of components that are utilized in the pump. The integral coupling of various components of the pump substantially reduces the likelihood of failure of potential leak points and permits the pump to operate continuously for a longer period and with greater reliability than previously utilized pumps. The absence of discrete elements also allows the pump to be utilized in a greater number of applications without requiring special design considerations for the fluid being pumped. Additionally the absence of discrete seal elements and the reduced number of components reduces the costs and complexity of manufacturing the pump.

Figure 1:
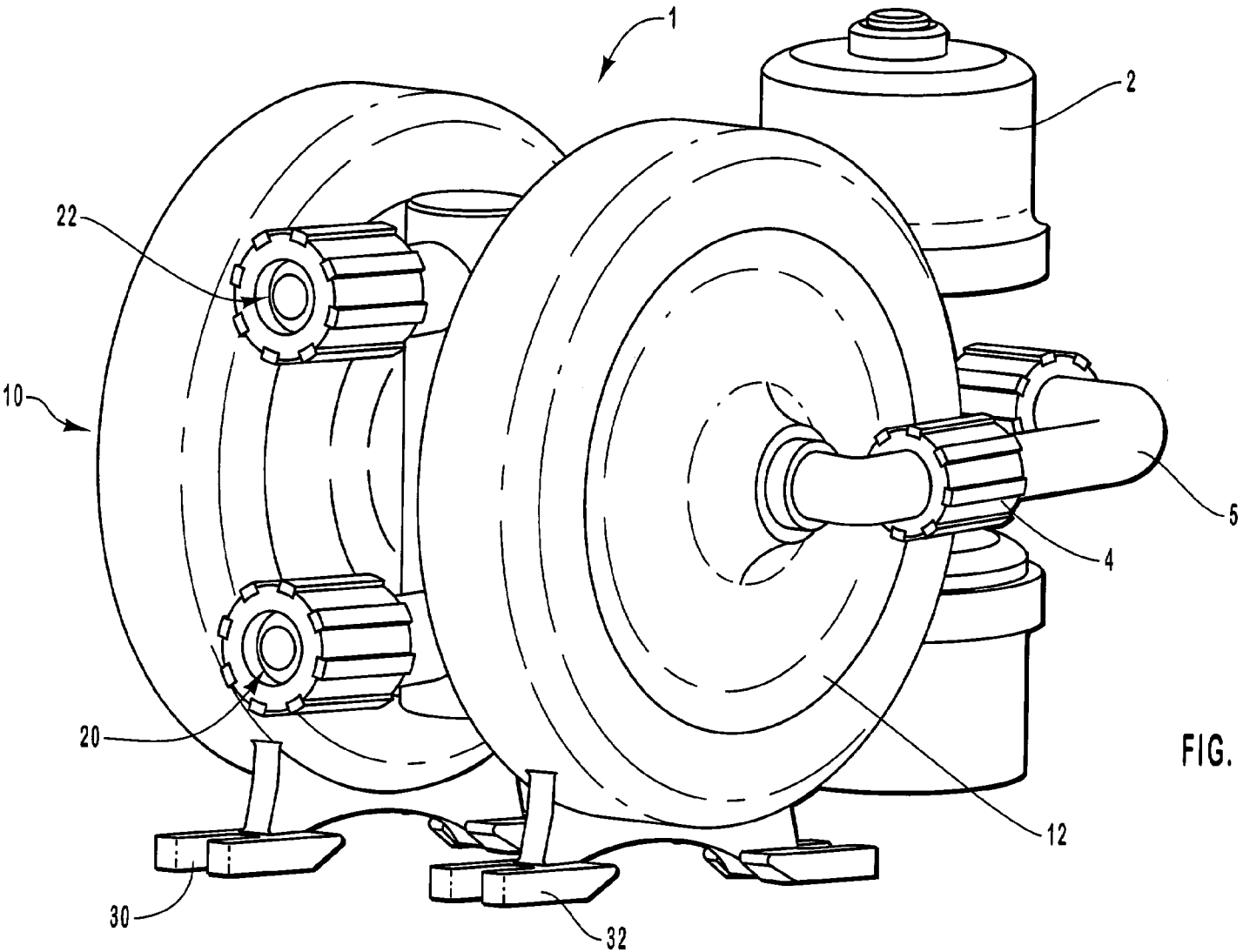
FIG. 1 is a perspective view illustrating a pump according to one aspect of the present invention.

With reference now to FIG. 1, there is shown a perspective view of a pump 1 according to one aspect of the present invention. Pump 1 has a unitary construction such that the fluid being pumped is prevented from leaking without the use of discrete seal elements. In the illustrated embodiment, pump 1 is a double diaphragm pump having components that are molded or welded to achieve the unitary construction of pump 1. The components of pump 1 can be fabricated of materials that are compatible with applications in which avoiding contamination of ultra high purity material is critical. Moreover, the pumps of the invention are suitable for use in specialized applications, such as those associated with semiconductor fabrication, in which continuous usage of the pumps is important. A variety of types and configurations of pumps can be utilized without departing from the scope and spirit of the present invention. For example, in one embodiment the pump is a bellows pump.

FIG. 1 illustrates an oscillator 2 coupled to pump 1. Oscillator 2 provides the pumping force utilized by pump 1 to displace the fluid being pumped. Pump 1 is coupled to oscillator 2 utilizing a coupler 4 and tubing 5. Coupler 4 allows pump 1 and oscillator 2 to be disconnected allowing pump 1 or oscillator 2 to be removed or replaced. Tubing 5 allows oscillator 2 to convey pumping force to pump 1 utilizing pneumatic or fluid pressure. As will be appreciated by those skilled in the art, pump 1 can be utilized independently of oscillator 2. A variety of types and configurations of mechanisms for providing pumping force to the pump can be utilized without departing from the scope and spirit of the present invention. For example, a pilot valve can be integrated in the pump to provide the pumping force required to displace the fluid being pumped.

In the illustrated embodiment, pump 1 includes a first head 10, a second head 12, a pump body 16, an inlet port 20, an outlet port 22, a base member 30, and a base member 32. First head 10, which is coupled to pump body 16, includes a pumping chamber corresponding with a first diaphragm for displacing a fluid. Second head 12 is coupled to pump body 16 to provide a pumping chamber corresponding with a second diaphragm for displacing a fluid. Pump body 16 provides the structural strength and support to pump 1 needed for proper functioning of many of the components of pump 1, while providing protection from the external environment. In the illustrated embodiment, the configuration of pump body 16 reduces the number of components of pump 1, while preventing leakage of the fluid being pumped without the use of discrete seal elements. In the preferred embodiment, pump body 16 has molded construction. In an alternative embodiment, pump body 16 has a machined construction.

Inlet port 20, which is coupled to pump body 16, provides an intake allowing fluid to be delivered to pump 1. In the illustrated embodiment, inlet port 20 includes a coupler for coupling inlet port 20 to a fluid delivery mechanism, such as tubing or conduit. Outlet port 22 is coupled to pump body 16 above inlet port 20 and allows fluid being pumped by pump 1 to be delivered from the pump to its target destination. In the illustrated embodiment, outlet port 22 includes a coupler for coupling outlet port 22 to a fluid delivery mechanism, such as tubing or conduit.

Base members 30 and 32 of FIG. 1 are coupled to pump body 16. Base members 30 and 32 optionally secure pump 1 to flooring, machinery, or other surfaces, to prevent movement and potential damage to pump 1. Base members 30 and 32 accommodate a bolt or other fastener to secure pump 1. A variety of types and configurations of base members and mechanisms for securing base members can be utilized without departing from the scope and spirit of the present invention.

Figure 2:
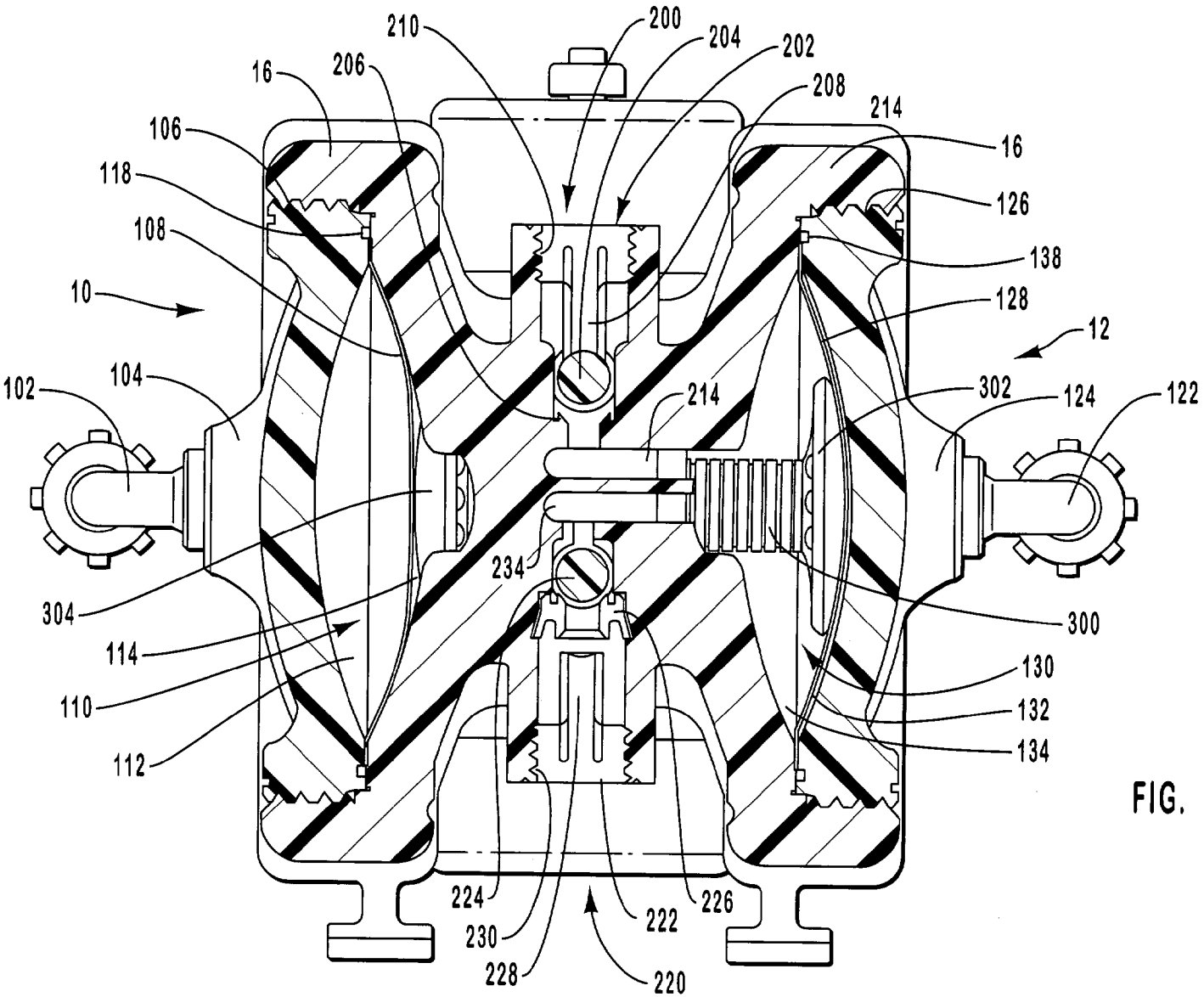
FIG. 2 is a cross-sectional view of the pump illustrating the manner which components of the pump are integrally connected according to one aspect of the present invention.

With reference now to FIG. 2, there is shown a cross-sectional view of pump 1 taken along lines 2—2 (see FIG. 1). The manner in which the components of pump 1 are integrally connected to one another prevents fluid from leaking from pump 1 without requiring the use of discrete seal elements. In the illustrated embodiment, pump 1 includes a first head 10, a second head 12, a pump body 16, a diaphragm 108, a pumping chamber 110, a diaphragm 128, a pumping chamber 130, a check valve 200, and a check valve 220.

First head 10 is integrally coupled to pump body 16 to form a pumping chamber 110. A variety of types and configurations of connections can be utilized to integrally couple first head 10 to pump body 16. For example, in one embodiment, first head 10 and pump body 16 are molded to form a unitary member. In the illustrated embodiment, first head 10 is welded to pump body 16. A variety of types and configurations of welds can be utilized to couple first head 10 to pump body 16. For example, in one embodiment, additional material is utilized to form a bead weld to integrally couple first head 10 to pump body 16. In an alternative embodiment, a hot stamp or other mechanism is applied to both first head 10 and pump body 16 to stamp weld first head 10 to pump body 16.

In the illustrated embodiment, first head 10 includes tubing 102, flange 104, and threads 106. Tubing 102 allows an oscillator or other mechanism to be coupled in fluid connection with pumping chamber 110. Flange 104 is positioned at the base of tubing 102. Flange 104 provides additional strength to the base of tubing 102 to prevent breakage of tubing 102. Threads 106 are positioned around the outer circumference of first head 10 at the portion of first head 10 that contacts pump body 16. Threads 106 threadably engage threads of pump body 16. The threaded coupling provides additional strength to the fluid-impermeable seal formed between first head 10 and pump body 16. The additional strength can be particularly important where the mechanism providing the integral coupling, such as a bead or stamp weld, provides insufficient strength to maintain the integral coupling of first head 10 and pump body 16.

Diaphragm 108 is positioned in pumping chamber 110. Diaphragm 108 provides a fluid-impermeable seal dividing pumping chamber 110 into a pressure chamber 112 and a displacement chamber 114. Diaphragm 108 comprises a deformable membrane that fluctuates between a first and second position so as to alternatively expand and contract pressure chamber 112 and displacement chamber 114. Diaphragm 108 is one example of a displacement mechanism.

In the illustrated embodiment, the internal profiles of first head 10 and pump body 16 forming pumping chamber 110 conform to the shape of diaphragm 108. By conforming to the shape of diaphragm 108, the internal profiles of first head 10 and pump body 16 minimize pressure induce deterioration of diaphragm 108 by providing additional support to diaphragm 108. In the first position, diaphragm 108 is positioned adjacent the internal profile of first head 10. In the second position, diaphragm 108 is positioned adjacent the internal profile of pump body 16. The additional support provided by first head 10 and pump body 16 is particularly useful in applications where high pressures or high rates of oscillation can result in deterioration of diaphragm 108.

Diaphragm 108 is coupled between first head 10 and pump body 16 to form a diaphragm coupling 118. In the illustrated embodiment, diaphragm coupling 118 forms an annular ring between first head 10 and pump body 16. Diaphragm 108 is integrally coupled to pump body 16 to prevent leakage of fluid without the use of discrete seal elements. In one embodiment, diaphragm 108 is welded directly to pump body 16 by means of a stamp seal or bead seal. In an alternative embodiment, diaphragm 108 is integrally coupled to first head 10. In the embodiment illustrated in FIG. 2, first head 10 is integrally coupled to pump body 16 to form an indirect integral coupling between diaphragm 108 and pump body 16.

In the illustrated embodiment, diaphragm coupling 118 is sandwiched between first head 10 and pump body 16. The sandwiched configuration of diaphragm coupling 118 provides additional strength to the integral coupling of diaphragm 108 to pump body 16. The additional strength can be important where the integral coupling between diaphragm 108 and pump body 16 is insufficient to provide the strength required to maintain the coupling of diaphragm 108 to pump body 16. In one embodiment, diaphragm 108 includes an annular flange corresponding with diaphragm coupling 118. In this case, a void is provided between first head 10 and pump body 16 to accommodate the annular flange. In an alternative embodiment, diaphragm 108 is substantially uniform in nature, in which case, the outer circumference of diaphragm 108 forms a face seal between first head 10 and pump body 16 at the point of diaphragm coupling 118.

Second head 12 is integrally coupled to pump body 16, forming a pumping chamber 130. A variety of types and configurations of connections can be utilized to integrally couple second head 12 to pump body 16. For example, in one embodiment, second head 12 and pump body 16 are molded to form a unitary member. In the illustrated embodiment, second head 12 is welded to pump body 16. A variety of types and configurations of welds can be utilized to couple second head 12 to pump body 16. For example, additional material can be used to form a bead weld to integrally couple second head 12 to pump body 16. Alternatively, a hot stamp or other mechanism can be applied to both second head 12 and pump body 16 to stamp weld second head 12 to pump body 16.

According to the embodiment illustrated in FIG. 2, second head 12 includes tubing 122, flange 124, and threads 126. Tubing 122 allows an oscillator or other mechanism to be coupled in fluid connection with pumping chamber 130. Flange 124 is positioned at the base of tubing 122 and provides additional strength to the base of tubing 122 to prevent breakage of tubing 122. Threads 126 are positioned around the outer circumference of second head 12 at the portion of second head 12 that contacts pump body 16. Threads 126 threadably engage threads of pump body 16. The threaded coupling provides additional strength to the fluid-impermeable seal formed between second head 12 and pump body 16. The additional strength can be particularly important where the mechanism providing the integral coupling, such as a bead or stamp weld, provides insufficient strength to prevent failure of the fluid-impermeable seal.

Diaphragm 128 is positioned in pumping chamber 130 and forms a fluid-impermeable seal dividing pumping chamber 130 into a pressure chamber 132 and a displacement chamber 134. Diaphragm 128 comprises a deformable membrane that fluctuates between a first and second position to alternatively expand and contract pressure chamber 132 and displacement chamber 134.

In the illustrated embodiment, the internal profiles of second head 12 and pump body 16 forming pumping chamber 130 conform to the shape of diaphragm 128. By conforming to the shape of diaphragm 128, the internal profiles of second head 12 and pump body 16 minimize pressure induce deterioration of diaphragm 128 by providing additional support to diaphragm 128. In the first position, diaphragm 128 is positioned adjacent the internal profile of second head 12. In the second position, diaphragm 128 is positioned adjacent the internal profile of pump body 16. The additional support provided by second head 12 and pump body 16 is particularly useful in applications where high pressures or high rates of oscillation can result in deterioration of diaphragm 128.

Diaphragm 128 is coupled between second head 12 and pump body 16 to form a diaphragm coupling 138. In the illustrated embodiment, diaphragm coupling 138 forms an annular ring between second head 12 and pump body 16. Diaphragm 118 is integrally coupled to pump body 16 to prevent leakage of fluid without the use of discrete seal elements. In one embodiment, diaphragm 118 is welded directly to pump body 16 by means of a stamp seal or bead seal. In an alternative embodiment, diaphragm 118 is integrally coupled to second head 12, in which case, second head 12 is integrally coupled to pump body 16 to form an indirect integral coupling between diaphragm 118 and pump body 16.

In the illustrated embodiment, diaphragm coupling 138 is sandwiched between second head 12 and pump body 16. The sandwiched configuration of diaphragm coupling 138 provides additional strength to the integral coupling of diaphragm 128 to pump body 16. The additional strength can be important where the integral coupling between diaphragm 128 and pump body 16 is insufficient to provide the strength required to maintain contact between diaphragm 128 and pump body 16. In one embodiment, diaphragm 128 includes an annular flange corresponding with diaphragm coupling 138. In this case, a void is provided between second head 12 and pump body 16 to accommodate the annular flange. In an alternative embodiment, diaphragm 128 is substantially uniform in nature, in which case, the outer circumference of diaphragm 128 forms a face seal between second head 12 and pump body 16 at the point of diaphragm coupling 138.

FIG. 2 also illustrates a shaft 300, a first push plate 302, and a second push plate 304. Shaft 300 is coupled to first push plate 302 and second push plate 304 to ensure uniform spacing between first push plate 302 and second push plate 304. Shaft 300 is disposed between diaphragms 108 and 128. First push plate 302 and second push plate 304 are adapted to contact diaphragms 108 and 128 and to maintain a uniform displacement between diaphragm 108 and diaphragm 128.

Check valve 200 and check valve 220 are coupled to pump body 16. Check valve 200 corresponds with outlet port 22, while check valve 220 corresponds with inlet port 20. Check valves 200 and 220 ensure a unidirectional flow of fluid through pump by preventing back flow of fluid. Check valves 200 and 220 correspond with pumping chamber 130. Fluid being drawn into pumping chamber 130 passes through check valve 220. Fluid being pumped from pumping chamber 130 passes through check valve 200.

Check valve 200 is integrally coupled to pump body 16 and includes a check plug 202, a ball 204, and a seat 206. Check plug 202 maintains the proper placement of ball 204 while preventing leakage of fluid into the external environment. Check plug 202 includes a projection 208 that selectively contacts ball 204 to maintain proper positioning of ball 204. Check plug 202 further includes threads 210 that engage threads of pump body 16 to provide additional strength to the point of coupling between check plug 202 and pump body 16.

Check plug 202 is integrally coupled with pump body 16 to prevent leakage of fluid without the use of discrete seal elements. A variety of types and mechanisms for providing integral coupling can be utilized, including a bead weld or a stamp weld. In one embodiment, check plug 202 is coupled to pump body 16 without the use of threads. In this case, the manner in which check plug 202 is integrally coupled to pump body provides the strength needed to prevent failure of the fluid-impermeable seal. The use of check plug 202 allows ball 204 to be inserted into seat quickly and efficiently. Ball 203 can then be secured by the positioning check plug 202.

Ball 204 is positioned between check plug 202 and seat 206 and is capable of moving within a limited range to permit the flow of fluid in one direction while preventing the back flow of fluid in the opposite direction. Seat 206, which is integrally coupled to pump body 16, selectively contacts ball 204 and maintain the position of ball 204. In the illustrated embodiment, seat 206 conforms to the shape of ball 204 to prevent the black flow of fluid.

Check valve 220 is integrally coupled to pump body 16 and includes a check plug 222, a ball 224, and a seat 226. Check plug 222 maintains the proper placement of ball 224 while preventing leakage of fluid into the external environment. Check plug 222 includes a projection 228 that selectively contacts ball 224 to maintain proper positioning of ball 224. Check plug 222 further includes threads 230 that engage threads of pump body 16 to provide additional strength to the point of coupling between check plug 222 and pump body 16.

Check plug 222 is integrally coupled with pump body 16 to prevent leakage of fluid without the use of discrete elements. A variety of types and mechanisms for providing integral coupling can be utilized, including a bead weld or a stamp weld. In one embodiment, check plug 202 is coupled to pump body 16 without the use of threads. In this case, the manner in which check plug 202 is integrally coupled to pump body provides the strength needed to prevent failure of the fluid impermeable seal. The use of check plug 222 allows ball 224 to be inserted into seat quickly and efficiently. The ball 224 can then be secured by the positioning check plug 222.

Ball 224 is positioned between check plug 222 and seat 226. Ball 224 is moveable within a limited range to permit the flow of fluid in one direction while preventing the back flow of fluid in the opposite direction. Seat 226 is coupled to pump body 16. Once ball 204 is placed in the proper position, seat 226 is positioned behind ball to hold ball in place. Once positioned, seat 226 selectively contacts ball 224 and maintains the position of ball 224. Seat 226 conforms to the shape of ball 204 to prevent the black flow of fluid. In the illustrated embodiment, seat 226 includes resilient members that allow seat 226 to be pushed into place. When seat 226 is correctly positioned, the resilient members engage pump body 16 to maintain seat 226 in the correct position.

Displacement chamber 134 expands and contracts due to the movement of diaphragm 128. As displacement chamber 134 expands, fluid is drawn into displacement chamber 134 through check valve 220. The configuration of check valve 220 allows fluid to pass ball 224 to fill displacement chamber 134. While fluid is entering displacement chamber 134 through check valve 220, ball 204 of check valve 200 is forced against seat 206 to prevent the back flow of fluid into displacement chamber 134 through check valve 200. By preventing back flow of fluid into displacement chamber 134, check valve 200 ensures that fluid is drawn into displacement chamber 134 through check valve 220.

As displacement chamber 134 contracts, fluid is expelled from displacement chamber 134 through check valve 200. The configuration of check valve 200 allows fluid to be pumped past ball 204 to outlet port 22. As the fluid is pumped through check valve 200, ball 224 of check valve 220 is forced against seat 226, preventing the back flow of fluid into displacement chamber 134. By preventing the back flow of fluid into displacement chamber 134, check valve 220 ensures that fluid is expelled from displacement chamber 134 through check valve 200.

FIG. 2 also shows channels 214 and 234, which are in fluid connection with displacement chamber 134. Channels 214 and 234 are positioned between check valves 200 and 220 and displacement chamber 134. As displacement chamber 134 expands, fluid passes from check valve 220, through channel 234, and then into displacement chamber 134. As displacement chamber 134 contracts, fluid passes from displacement chamber 134, through channel 214, and through check valve 200.

The integral coupling of first head 10, second head 12, check valve 200, and check valve 220 results in a unitary construction of pump 1. The unitary construction of pump 1 prevents fluid from leaking from pump 1 without requiring the use of discrete seal elements. The integral coupling of first and second diaphragms 108 and 128 allows fluid to be pumped, while preventing the fluid from leaking from displacement chambers 114 and 134, without requiring the use of discrete seal elements. As a result, fluid can enter and exit pump 1 only through inlet port 20 and outlet port 22.

By preventing leaking without the use of discrete seal elements, the pump can be utilized in most or all ultra high purity applications without requiring special design changes for different types of fluids being pump. The lack of discrete seal elements allows the pump to be utilized in variety of ultra high purity applications, while avoiding contamination of the fluid being pumped. By eliminating the use of discrete seal elements, pump 1 can be constructed entirely of materials that are compatible with operating conditions in which ultra high purity materials are pumped. The unitary construction of pump 1 avoids contamination of the fluid being pumped even where the diaphragm is perforated or a leak otherwise occurs. This obviates the need for the use of leak detection of other mechanisms with pump 1. The unitary construction of pump 1 also allows pump 1 to be constructed utilizing fewer moveable parts and a smaller total number of parts. The reduction in the number of parts simplifies the design, reduces the cost of manufacturing, increases the reliability, and results in a longer life of pump 1.

Figure 3:
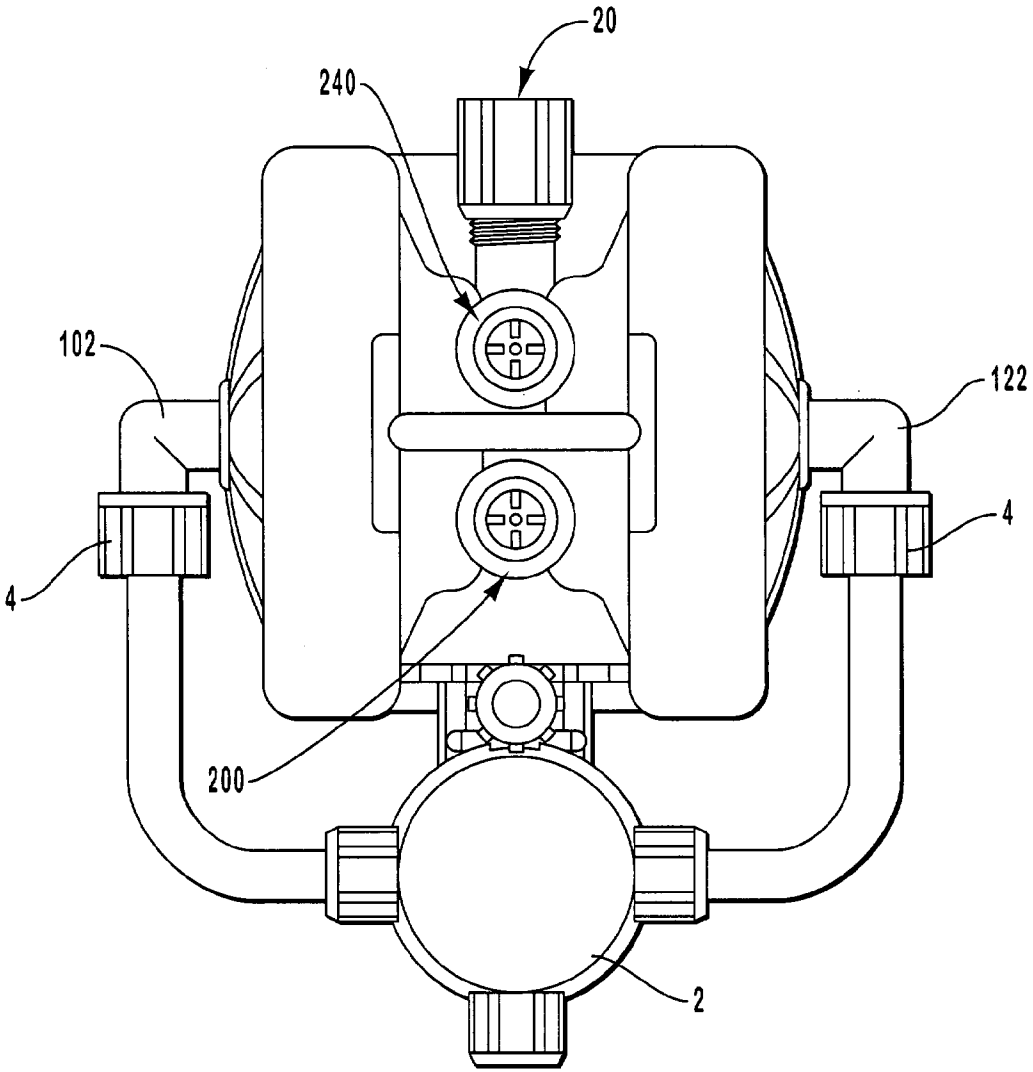
FIG. 3 is a top view of the pump illustrating the position of the check valves according to one aspect of the present invention.

With reference now to FIG. 3, there is shown a top view of pump 1, illustrating check valve 200 and a check valve 240. Check valve 200 is positioned above check valve 220 (see FIG. 2). Check valves 200 and 220 are in fluid communication with the pumping chamber associated with second head 12. Check valves 200 and 220 ensure a unidirectional flow of fluid through the pumping chamber associated with second head 12. Check valve 200 limits the back flow of fluid exiting the displacement chamber corresponding with second head 12. Check valve 220 minimizes the backflow of fluid entering the displacement chamber corresponding with second head 12.

Check valve 240 is positioned above a check valve 260 (see FIG. 2). Check valves 240 and 260 are in fluid communication with the pumping chamber associated with first head 10. Check valves 240 and 260 ensure a unidirectional flow of fluid through the pumping chamber associated with first head 10. Check valve 240 limits the backflow of fluid exiting the displacement chamber corresponding with first head 10. Check valve 260 minimizes the backflow of fluid entering the displacement chamber corresponding with first head 10.

In the illustrated embodiment, a single outlet port 22 is utilized. While not shown in FIG. 3, a single inlet port 20 (see FIG. 1) is also utilized. Inlet port 20 is positioned below outlet port 22 as illustrated in FIG. 1. Inlet port 20 and outlet port 22 provide an inlet and outlet for the pumping chambers of both first head 10 and second head 12. Outlet port 22 is in fluid communication with both check valves 200 and 240. Inlet port is in fluid communication with both check valves 220 and 260.

Figure 4:
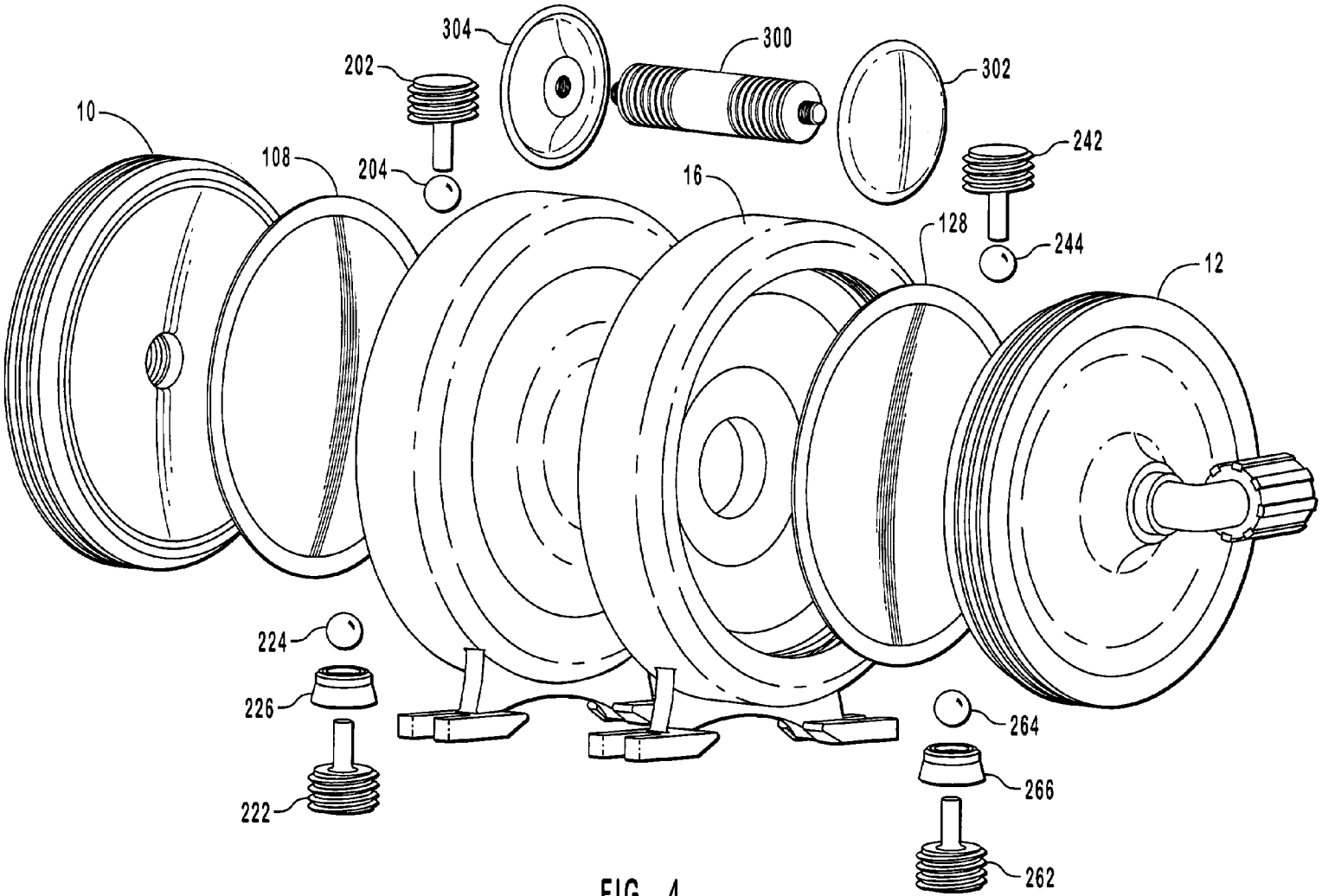
FIG. 4 is an exploded view of the pump illustrating the components utilized in constructing the pump according to one aspect of the present invention.

With reference now to FIG. 4, there is shown an exploded view of pump 1 illustrating the components utilized in pump 1 according to one aspect of the present invention, including a pump body 16, a first head 10, a second head 12, a first diaphragm 108, a second diaphragm 128, seats 226 and 266, balls 204, 224, 244, and 264, and check plugs 202, 222, 242, and 262. As previously explained, first head 10 and second head 12 are integrally coupled to pump body 16. First and second diaphragm 108 and 128 are also integrally coupled to pump body 16. Balls 204, 224, 244, and 264 are positioned adjacent to the pump body as part of a check valve. Seats 226 and 266 are placed beneath balls 224 and 264 to hold balls 224 and 264 in position and to function as part of a check valve. Check plugs 202, 222, 242, and 262 are integrally coupled to pump body 16 as part of a check valve. Check plugs 202, 222, 242, and 262 limit the movement of balls 204, 224, 244, and 264.

Integral coupling of the pump body 16, first and second heads 10 and 12, first and second diaphragms 108 and 128, and check plugs 202, 222, 242, and 262, result in a unitary construction of pump 1 such that fluid is prevented from leaking without the use of discrete seal elements. The absence of discrete seal elements substantially reduces the number of parts that are utilized in pump 1. The integral coupling of various components of pump 1 substantially reduces the likelihood of failure of potential leak points, results in a more reliable construction of pump 1, and permits pump 1 to operate continuously for a longer period and with greater reliability than previously utilized pumps. The absence of discrete elements allows pump 1 to be utilized in a greater number of applications without requiring special design consideration for the fluid being pumped. Additionally, the absence of discrete seal elements and the reduced number of components reduces the costs and complexity of manufacturing pump 1.

Figure 5:
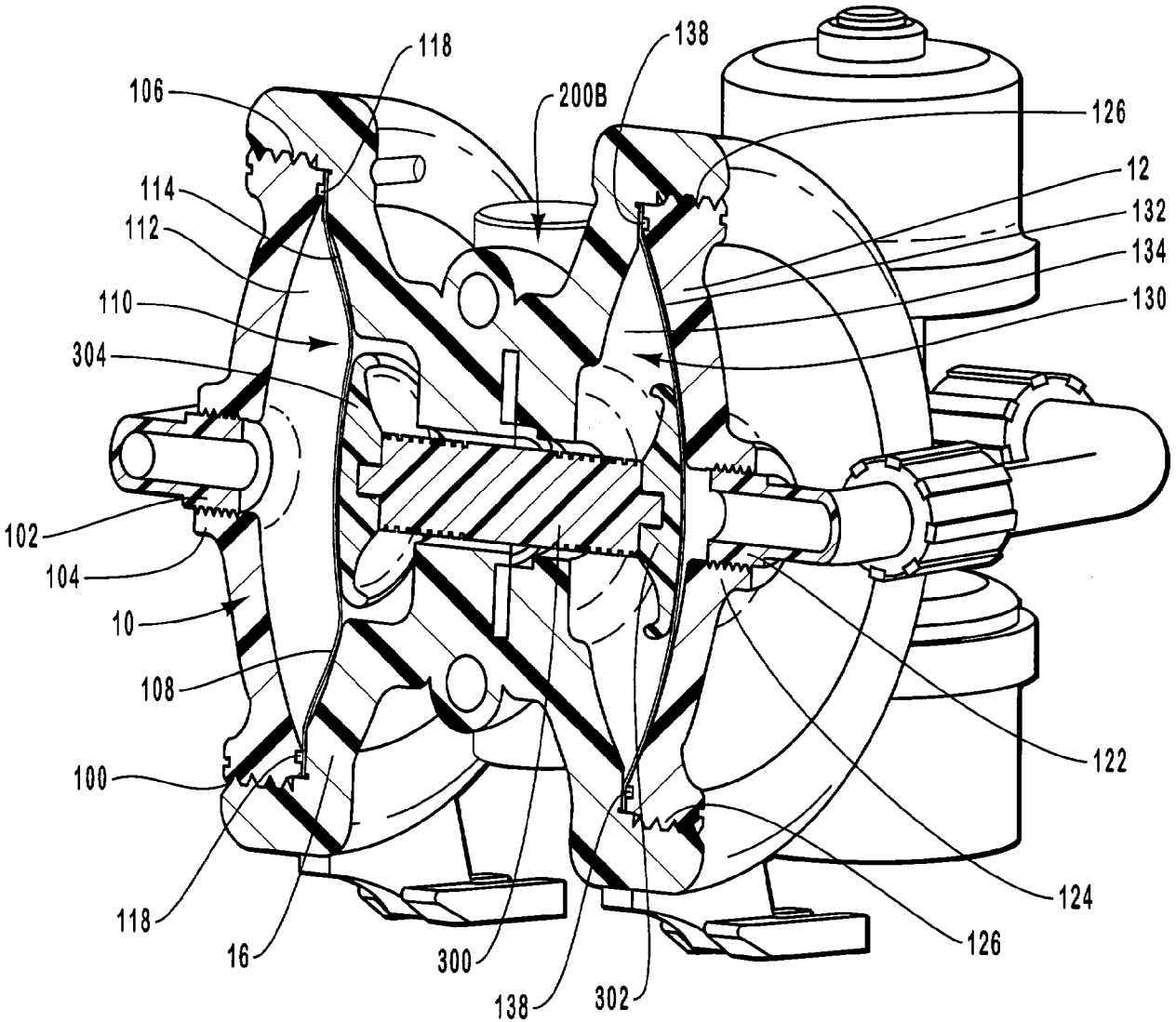
FIG. 5 is a perspective cut-away view of the pump illustrating the manner in which the push plates are utilized in connection with the diaphragms according to one aspect of the present invention.

With reference now to FIG. 5, there is shown a perspective cutaway view of pump 1 illustrating first pumping chamber 110 of first head 10 and second pumping chamber 130 of second head 12, and the manner in which first push plate 302 and second push plate 304 are utilized in connection with diaphragm 108 and diaphragm 128 according to one aspect of the invention. In the illustrated embodiment, diaphragm 108 is positioned adjacent the internal profile of pump body 116. Similarly, diaphragm 118 is positioned adjacent the internal profile of second head 12.

The position of diaphragms 108 and 128 results from the pressure differential between pressure chamber 112 and pressure chamber 132. The pressure differential between pressure chamber 112 and pressure chamber 132 results from the manner in which oscillator 2 cyclically increases the air pressure in one pressure chamber while decreasing the air pressure in the other pressure chamber.

Oscillator 2 decreases the air pressure in pressure chamber 112 by connecting pressure chamber 112 with an exhaust in oscillator 2 to reverse the air pressure differential between pressure chambers 112 and 132. As the air pressure in pressure chamber 112 is exhausted, the air pressure in pressure chamber 132 begins to build as pressure chamber 132 is connected with an air pressure source. As the air pressure differential begins to reverse, diaphragms 108 and 128 are deformed in the reverse direction such that diaphragm 108 is positioned adjacent the internal profile of first head 10 while second diaphragm 128 is positioned adjacent the internal profile of pump body 16.

As diaphragms 108 and 128 oscillate between their rightmost and leftmost displacements, shaft 300, first push plate 302, and second push plate 304 maintain the spacing between diaphragm 108 and 128. By maintaining the spacing between diaphragm 108 and diaphragm 128, fluid is alternatingly drawn into and forcibly expelled from displacement chambers 114 and 134 in a uniform and efficient manner.

Figure 6:
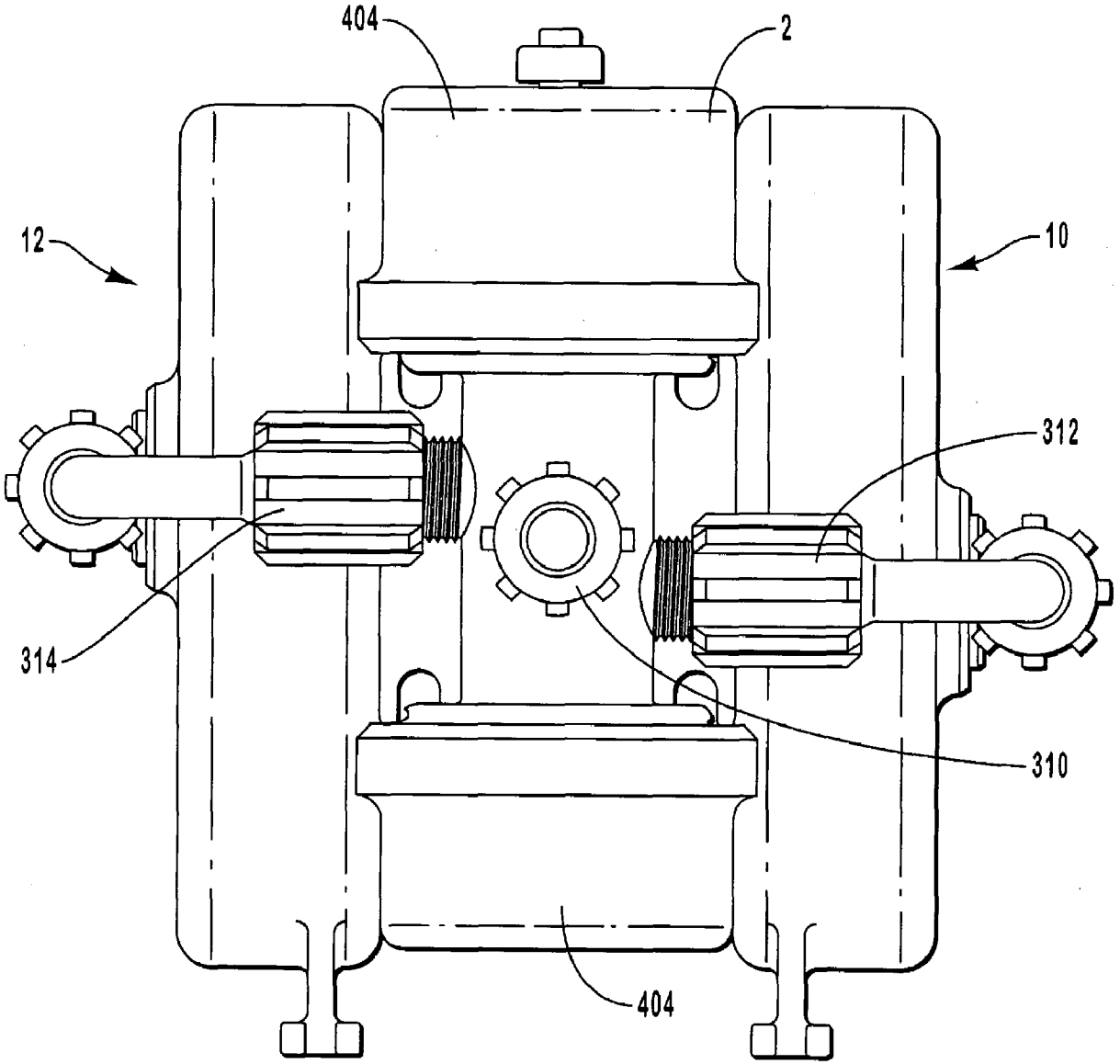
FIG. 6 is a back view of the pump and the oscillator according to one aspect of the present invention.

With reference now to FIG. 6, there is shown a back view of pump 1 (background) and oscillator 2 (foreground) according to one aspect of the present invention. In the illustrated embodiment, oscillator 2 supplies the pneumatic pressure to pump 1 required to displace the fluid being pumped. Oscillator 2 controls the rate of cycling of pump 100. A first supply port 312 of oscillator 2 is coupled to first head 10 of pump 1. A second supply port 314 of oscillator 2 is coupled to second head 12 of pump 1. The pumping chamber associated with first head 10 is pressurized by means of pneumatic pressure supplied from first supply port 312. Similarly, the pumping chamber associated second head 12 is pressurized by means of pneumatic pressure supplied from second supply port 314. First supply port 312 and second supply port 314 also provide a mechanism for alternatively exhausting the pressurized air in the pressure chambers.

First supply port 312 and second supply port 314 alternatingly pressurize and depressurize the pumping chambers associated with first head 10 and second head 12. For example, at a given point in time during operation of the pump, the pumping chamber associated with first head 10 can be undergoing pressurization by first supply port 312 while the pumping chamber associated with second head 12 is being depressurized by second supply port 314.

In the illustrated embodiment, pump 1 is a disposable module that can be detached from oscillator 1. This allows the pump to be quickly removed and replaced from the driving mechanism when one or more components of pump 1 fail. The unitary construction of pump 1 is such that when one or more of the components of the pump fail, the pump can be discarded. Due to the simple construction of the pump, the pump can be replaced relatively inexpensively. For example, in some circumstances, pump 1 can be replaced for the same cost as replacing the seal elements of comparable pumps. Additionally, because the pump can be replaced quickly and efficiently, the time that would otherwise be required to service the pump or to replace the seals elements is avoided.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A pump for pumping fluid, the pump being constructed of a ultra-high purity material to avoid contamination of the fluid being pumped, the pump comprising:

a displacement mechanism configured to contact a fluid;

a pump body coupled to the displacement mechanism to permit the fluid to be displaced by the displacement mechanism, the pump body having a unitary construction such that the fluid is prevented from leaking from the pump body;

a first head welded to the pump body to define a first pumping chamber, the displacement mechanism being disposed within the first pumping chamber; and a second head welded to the pump body to define a second pumping chamber.

2. The pump of claim 1, wherein the displacement mechanism comprises a diaphragm.

3. The pump of claim 1, further comprising a plurality of check plugs welded to the pump body.

4. The pump of claim 1, wherein the first and second pumping chambers each comprise a pressure chamber.

5. The pump of claim 3, wherein the displacement mechanism comprises a first and second diaphragm.

6. The pump of claim 5, wherein the first diaphragm is disposed within the first pumping chamber and the second diaphragm is disposed within the second pumping chamber.

7. The pump of claim 1, further comprising an inlet port and an outlet port wherein the inlet port functions as an intake, while the outlet port functions as an outlet for a fluid being displaced by the pump.

8. The pump of claim 7, further comprising a plurality of check valves.

9. A pump for pumping fluid, the pump being constructed of a ultra-high purity material to avoid contamination of the fluid being pumped, the pump comprising:

a first and second diaphragm configured to convey pumping force needed to displace the fluid being pumped, each of the first and second diaphragm having a flange and a continuous center portion; and a pump body coupled to the first and second diaphragm, the pump having a unitary construction such that the fluid is prevented from leaking;

a first head welded to the pump body and forming a first pumping chamber, wherein the first diaphragm separates the first pumping chamber into a first displacement chamber and a first pumping chamber; and a second head welded to the pump body and forming a second pumping chamber, wherein the second diaphragm separates the second pumping chamber into a second displacement chamber and a second pumping chamber.

10. The pump of claim 9, wherein the flange of the first diaphragm is configured to fit within a first groove formed in at least one of the pump body and the first head and wherein and second diaphragm is configured to fit within a second groove formed into at least one of the pump body and the second head.

11. The pump of claim 10, wherein the first and second diaphragm are welded to the pump body to achieve the unitary construction of the pump.

12. The pump of claim 9, wherein the flange of the first diaphragm is sandwiched between the pump body and the first head and the flange of the second diaphragm is sandwiched between the pump body and the second head.

13. The pump of claim 12, further comprising a plurality of check valves.

14. The pump of claim 13, wherein a first and second check valve are associated with the first pumping chamber and a third and fourth check valve are associated with the second pumping chamber.

15. The pump of claim 13, wherein each of the plurality of check valves comprise a ball and a check plug, wherein each check plug is welded to the pump body to form the check valve.

16. A pump for pumping fluid, the pump having a unitary construction such that the fluid is prevented from leaking, the pump comprising:

a pump body;

a first and second head integrally coupled to the pump body, the first and second head having a molded construction, the first head welded to a first portion of the pump body and forming a first pumping chamber, the second head welded to a second portion of the pump body and forming a second pumping chamber;

a first and second diaphragm integrally coupled to the pump body, the first diaphragm disposed in the first pumping chamber and the second diaphragm disposed in the second pumping chamber, the first and second diaphragm configured to convey the pumping force needed to displace the fluid being pumped; and one or more check valves configured to permit the passage of fluid in a single direction, the check valves comprising:

a check plug integrally coupled to the pump body;

a ball configured to selectively permit the passage of fluid; and a seat positioned adjacent the ball.

17. The pump of claim 16, wherein the first and second head are threadably coupled to the pump body.

18. The pump of claim 16, wherein the check plug of the one or more check valves are welded to the pump body.

19. The pump of claim 16, wherein the check plug of the one or more check valves are threadably coupled to the pump body.

20. The pump of claim 16, wherein each check plug of the one or more check valves is welded to the pump body.

21. The pump of claim 16, wherein the pump body is comprised of a single molded member.

22. The pump of claim 16, wherein the first and second diaphragm each comprise a continuous center portion bounded by a flange, a first flange of the first diaphragm configured to fit in a groove formed between the pump body and the first head and a second flange of the second diaphragm configured to fit in a groove formed between the pump body and the second head.

23. The pump of claim 22, wherein each of the first and second flange is positioned on the outside diameter of the first and second diaphragm such that the first diaphragm is secured to the pump body by the first head and the second diaphragm is secured to the pump body by the second head.

24. The pump of claim 23, wherein the flanges of the first and second diaphragms are configured to be integrally coupled to the first and second heads and the pump body so as to form a diaphragm coupling.

25. The pump of claim 16, wherein the first and second diaphragm are sandwiched between the pump body and the first and second heads.

26. A pump for pumping fluid, the pump being constructed of a ultra-high purity material to avoid contamination of the fluid being pumped, the pump comprising:

a driving mechanism providing the pumping force to pump the fluid; and a pump coupled to the driving mechanism such that the pumping force can be conveyed from the driving mechanism to displace the fluid, the pump comprising a disposable module that can be quickly removed and replaced from the driving mechanism when one or more components of the pump fail, the pump further comprising:

a first head welded to a pump body;

a second head welded to the pump body;

a first diaphragm sandwiched between the first head and the pump body; and a second diaphragm sandwiched between the second head and the pump body.

27. The pump of claim 26, wherein the pump further comprises a plurality of check plugs welded to the pump, wherein the welded check plugs and the welded at least one head prevent fluid from leaking without the use of discrete seal elements.

28. The pump of claim 27, wherein the unitary construction of the pump obviates the need to service the pump.

29. The pump of claim 27, wherein the unitary construction of the pump obviates the need to replace seal elements.

30. The pump of claim 26, wherein the driving mechanism comprises an oscillator.

31. The pump of claim 26, wherein the driving mechanism comprises a pilot valve integrally coupled to the pump.

* * * * *